United States Patent [19]

Reidt

[11] 4,245,387

[45] Jan. 20, 1981

[54] CABLE HARNESS ASSEMBLY FIXTURE

[75] Inventor: Dean K. Reidt, St. Paul, Minn.

[73] Assignee: Minnesota Mining and Manufacturing Company, Saint Paul, Minn.

[21] Appl. No.: 48,674

[22] Filed: Jun. 14, 1979

[51] Int. Cl.[3] ..... H01R 43/04

[52] U.S. Cl. ..... 29/749; 29/751; 29/753; 29/759

[58] Field of Search ..... 29/749, 751, 753, 759, 29/760, 865, 866

[56] References Cited

U.S. PATENT DOCUMENTS 4,148,130 4/1979 Stauffer et al. ..... 29/749 X

*Primary Examiner*—Carl E. Hall

*Attorney, Agent, or Firm*—Cruzan Alexander; Donald M. Sell; Terryl K. Qualey

[57] ABSTRACT

A cable harness assembly fixture having a crimping station and an elongate base plate movable with respect to the crimping station. A pair of spaced, parallel, locator support rails on the base plate are movable transversely of the base plate to vary the spacing between them and may be retained at selected spacings. A plurality of connector locators are supported on each of the locator support rails, are slidable along the rails and are securable to the rails. The connector locators are formed such that with the support rails set at a predetermined spacing two connector locators positioned in opposition, one on each of the supports reels, will engage and position the body of the cable connector on the base plate and will align the cable with the connector body.

5 Claims, 8 Drawing Figures

CABLE HARNESS ASSEMBLY FIXTURE

FIELD OF THE INVENTION

Figure 3:
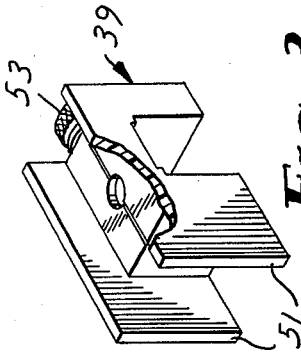

The present invention relates to a cable harness assembly fixture for applying a number of cable connectors to a cable to form a harness.

BACKGROUND OF THE INVENTION

It is often desirable to interconnect a plurality of electrical circuit units, such as printed circuit boards, many of which are similarly powered and actuated. Such interconnection is frequently provided by a multiconductor flat cable harness with a plurality of connectors spaced therealong at appropriate intervals. Such harnesses have been made by individually applying the connectors to the flat cable and carefully measuring as each succeeding connector is applied to assure the appropriate spacing. For applications where a large number of harnesses are necessary it is desirable to have an assembly fixture which will appropriately space and hold the connectors while they are applied to the cable and which will properly align the cable with the connectors. One such fixture is disclosed in U.S. Pat. No. 4,148,130. The apparatus of that patent is, however, unduly complex particularly if it is to be adapted to apply the various lengths of connectors currently available, which have from 10 to 64 contacts for connecting flat cable with a like number of conductors.

SUMMARY OF THE INVENTION

The present invention provides a cable harness assembly fixture comprising a crimping station defining a crimping position for applying a cable connector to a multi-conductor flat cable. An elongate base plate is supported for movement with respect to the crimping station longitudinally of the base plate to position selected portions thereof in the crimping position. A pair of spaced, parallel, locator support rails are supported on the base plate parallel to the longitudinal edges thereof, are movable transversely of the base plate to vary the spacing between them and are retainable at selected spacings. A plurality of connector locators are supported on each of the locator support rails. The connector locators are slidable along the rails, are securable to the support rails and are formed such that with the support rails set at a predetermined spacing two connector locators positioned in opposition, one on each of the support rails, will engage and position the body of a cable connector between them on the base plate. Means are provided for aligning a multiconductor flat cable with a connector body positioned between an opposed pair of connector locators.

THE DRAWING

Figure 4:
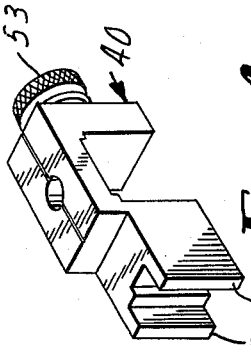
Figure 2:
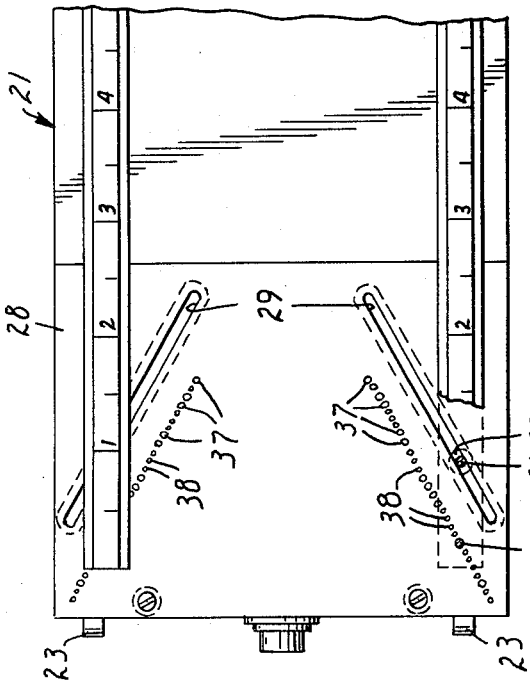
Figure 1:
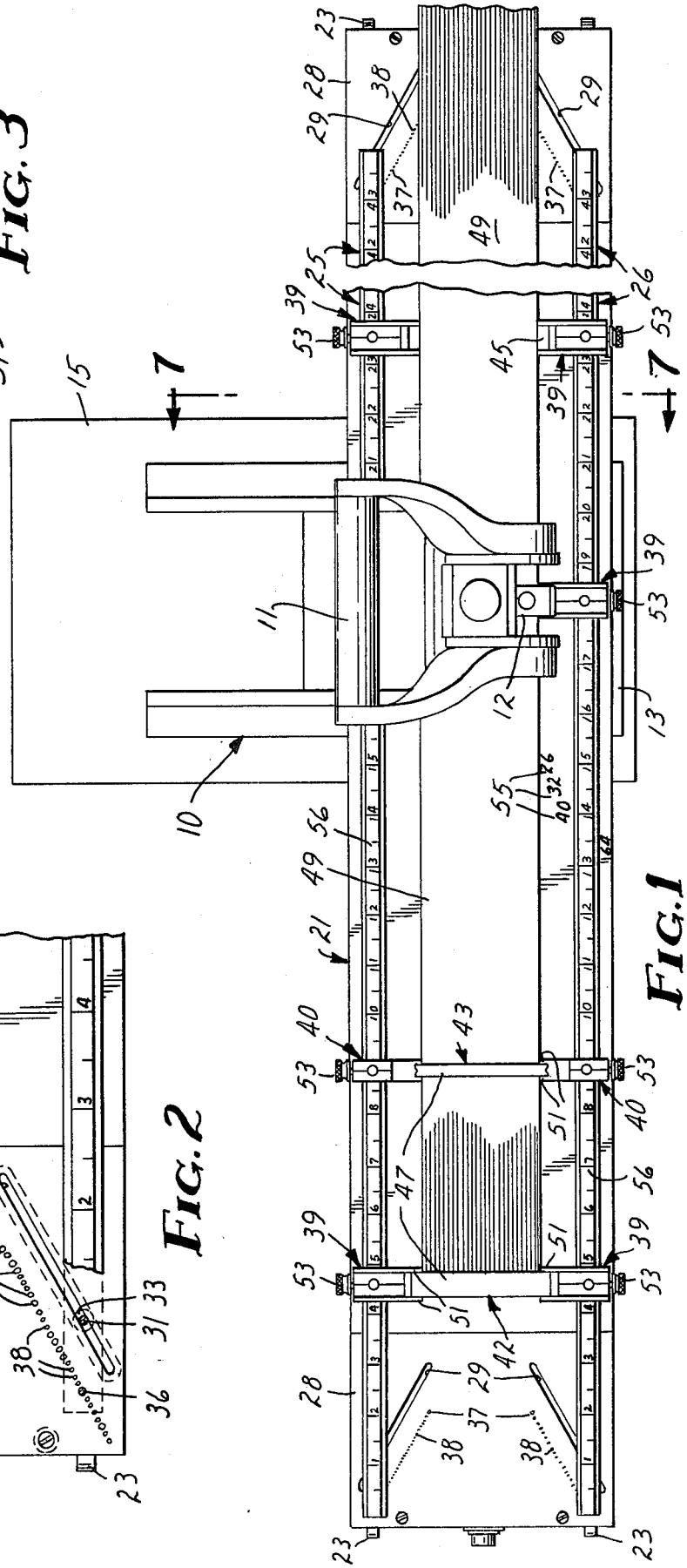
Figures 5, 6:
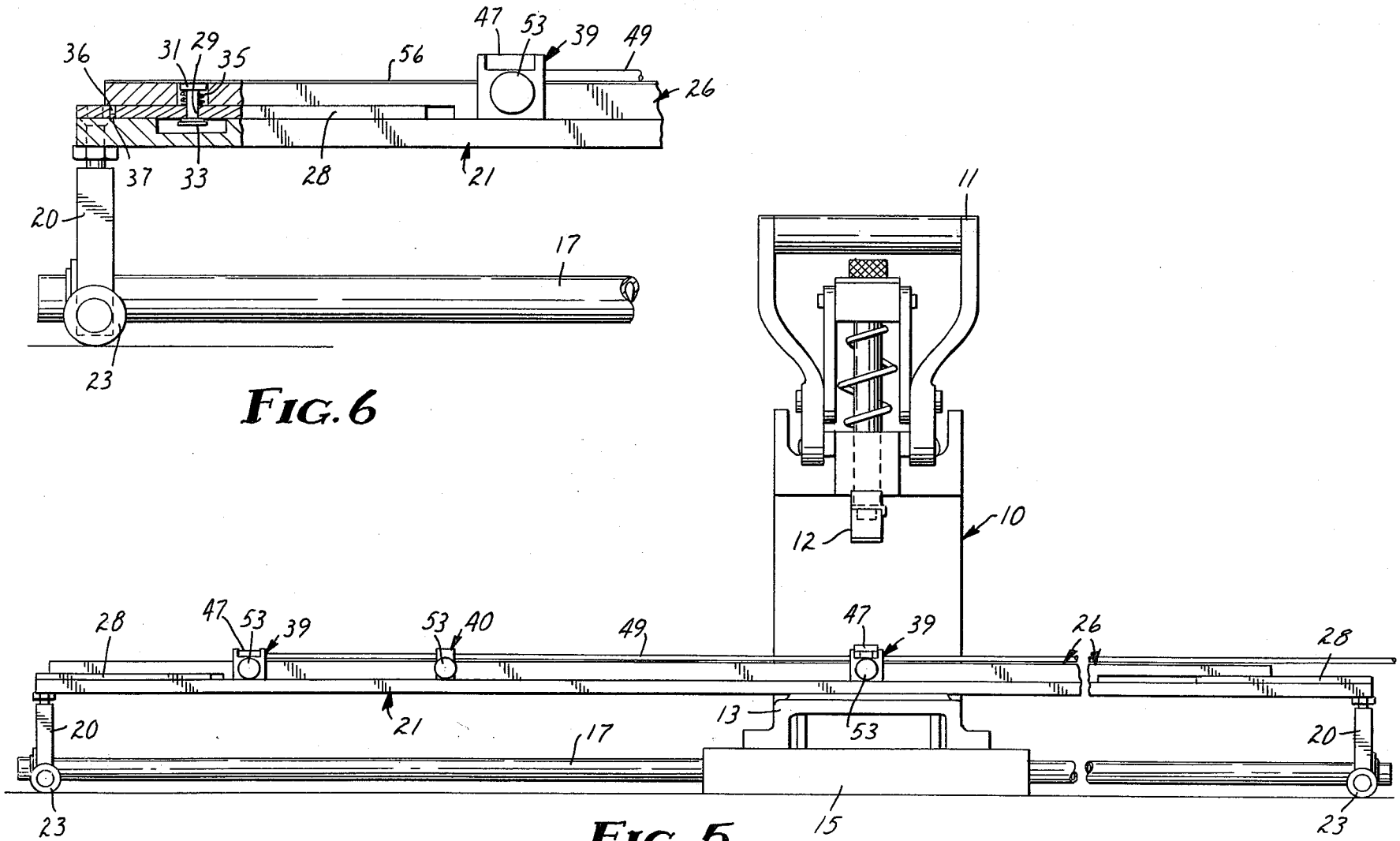
Figure 7:
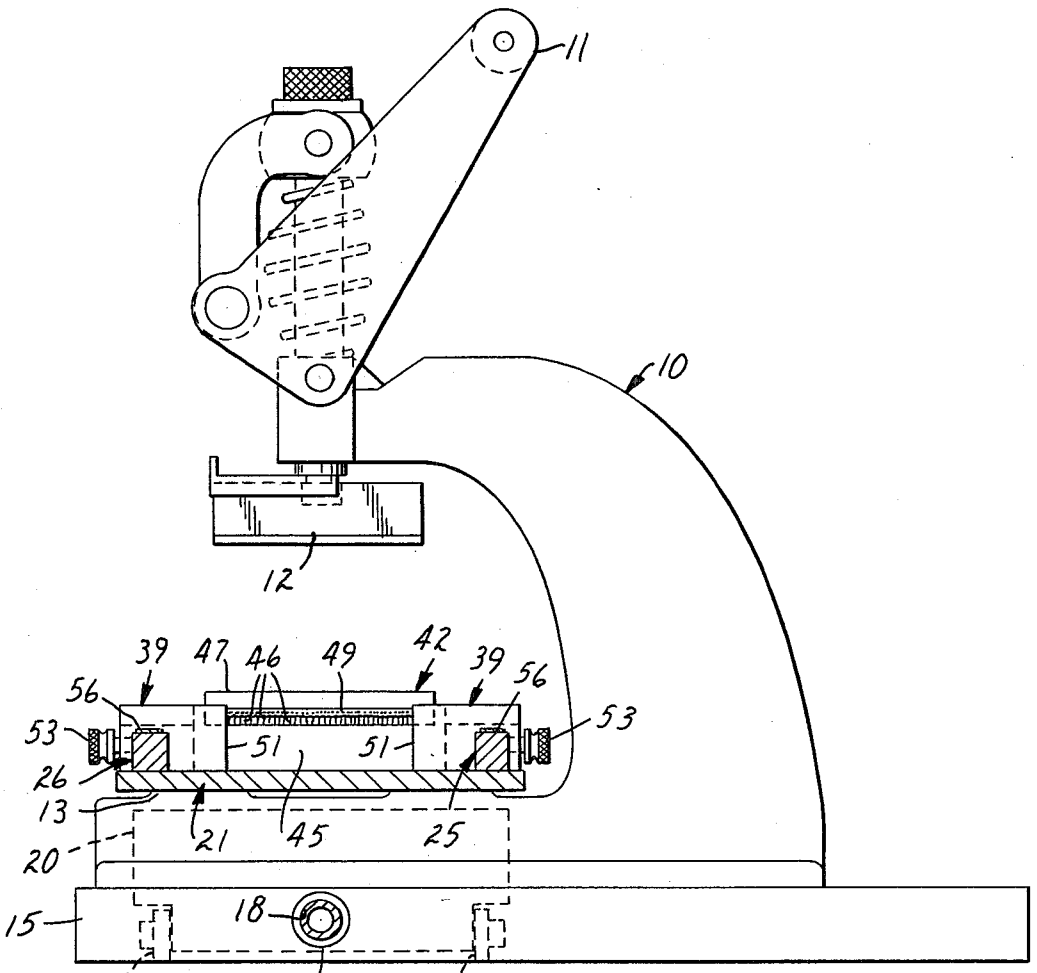
Figure 8:
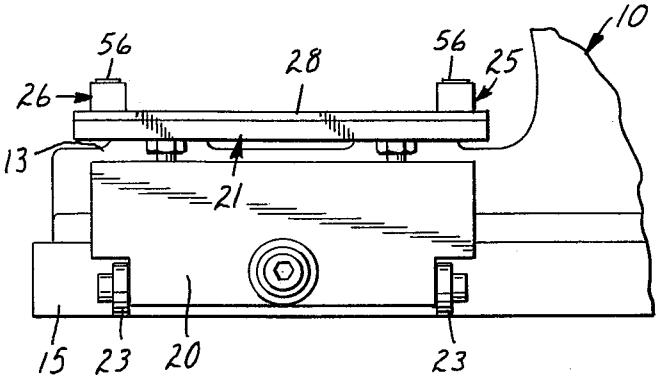

In the drawing:

FIG. 1 is a plan view of a cable harness assembly fixture constructed in accordance with the present invention with a portion broken away to reduce the length thereof, FIG. 2 is a plan view of one end of the fixture with portions broken away, FIG. 3 is a perspective view of one embodiment of a connector locator of the fixture, FIG. 4 is a perspective view of a second connector locator embodiment, FIG. 5 is a side elevation view of the fixture with a portion broken away as in FIG. 1, FIG. 6 is a side elevation view of one end of the fixture with portions broken away, FIG. 7 is an end elevation view of the fixture sectioned along line 7—7 of FIG. 1, and FIG. 8 is a partial end elevation view of the fixture.

A crimping press 10 has a pivotal handle 11 for moving a crimping platen 12 vertically toward and away from the press anvil 13. The crimping press 10 is secured to a metal base 15 by four screws passing upward through the base into threaded apertures in the anvil 13 of the press. The crimping press 10 defines a crimping station with a crimping position between the platen 12 and the anvil 13. The illustrated crimping press is a model 3640 Scotchflex assembly press available from the Minnesota Mining and Manufacturing Company with offices in St. Paul, Minnesota.

An elongate guide rod 17 passes through a horizontal aperture 18 transversely through the metal base 15 centrally below the platen 12. A vertical support plate 20 is secured at each end of the guide rod 17 and supports one end of an elongate horizontal base plate 21 so that a portion of the bottom of the base plate 21 rests on the anvil 13 of the crimping press 10. Metal wheels 23 at the bottom edges of the vertical support plates 20 contact a horizontal surface, such as a table top, on which the crimping press base 15 is set. The wheels 23 support the ends of the base plate 21 and facilitate movement of the base plate with respect to the crimping station longitudinally of the base plate to position selected portions of the base plate in the crimping position under the platen 12.

A pair of spaced, parallel, locator support rails 25 and 26 are supported on the base plate 21 parallel to the longitudinal edges thereof. The support rails 25 and 26 are movable transversely of the base plate 21 to vary the spacing between them. The locator support rails 25 and 26 are supported for movement transversely of the base plate by guide follower pins 31 depending from adjacent the ends of the support rails 25 and 26 which fit into guide slots 29 formed in end plates 28 secured to and forming a part of a base plate 21. A guide slot 29 is formed in the end plates 28 adjacent each of the ends of each of the support rails 25 and 26, the guide slots for each support rail being parallel and at an acute angle to the longitudinal centerline of the base plate. The guide slots 29 in each end plate 28 converge toward a point on the centerline of the base plate so that the locator support rails 25 and 26 move the same distance longitudinally of the base plate when moved the same distance transversely of it. In the illustrated embodiment the guide slots 29 are at an angle of 30° to the centerline of the base.

Below the end plates 28 a retaining ring 33 is pressed onto each of the guide follower pins 31 to retain the locator rails 25 and 26 on the base plate 21. Within each locator rail 25 and 26 each guide follower pin 31 is formed with a head which captures a spring 35 between itself and the rail 25 or 26 to permit the rail to be moved perpendicularly away from the base plate 21 a short distance against the spring 35 which resiliently biases the rail 25 or 26 toward the base plate 21.

The locator support rails 25 and 26 are retained at selected spacings by a retention pin depending from adjacent each end of each of the support rails 25 and 26 which fit into a series of similar apertures 37 formed into the surface of the end plates 28, one series of apertures along a line parallel to each of the guide slots 29. The apertures 37 are positioned to provide the proper spacing between the locator support rails 25 and 26 for various lengths of connectors which it may be desired to connect to a flat cable. The provision of guide slots 29 and parallel series of apertures that are at an acute angle to the longitudinal centerline of the base plate 21 permits closer transverse spacing of the apertures and thus permits apertures 37 to be provided for each of the connector sizes from the 10 contact connector to the 64 contact connector. In the illustrated embodiment smaller pilot holes 38 are provided among the retention apertures 37 to designate spacings for connectors in two contact increments from 10 to 64 contacts on 0.050 inch centers. Thus, if a connector with a new number of contacts becomes available, it is only necessary to drill the appropriate pilot holes 38 to the diameter of retention apertures 37.

A plurality of connector locators 39 and 40 are supported on each of the locator support rails 25 and 26, are slidable along the rails, are securable to the rails and are formed such that with the support rails 25 and 26 set at a predetermined spacing two similar connector locators 39 or 40 positioned in opposition, one on each of the support rails, will engage and position the body of a cable connector between them on the base plate 21. The connector locators 39 are formed to engage the ends of the body of a card edge connector 42 and the connector locators 40 are formed to engage the ends of the body of a socket connector 43. Connector locators for other styles of connectors will be readily apparent. The various predetermined spacings of the locator support rails 25 and 26 defined by the apertures 37 in the base plate 21 provides spacings for accepting various lengths of the connectors 42 and 43 by the same connector locators 39 and 40, respectively. The illustrated connectors are number 3415 card edge connectors 42 and number 3425 socket connectors 43 available from the Minnesota Mining and Manufacturing Company. Each connector has a body 45 carrying insulation stripping contact elements 46 and a cover 47 which fits onto the body 45 over a multi-conductor flat cable 49 and is pressed onto the body to carry the conductors of the cable 49 into the contact elements 46. The edges 51 of each of the connector locators 39 extend along a connector body 45 so that the edges 51 of opposed connector locators 39 or 40 are spaced the width of a flat cable 49 to assure its proper location with respect to the connector body 45 in the locator. Each connector locator 39 and 40 has a screw 53 with a knurled head for securing it to a locator rail 25 or 26 by hand.

Indicia 55 are provided on the base plate 21 for spacing the locator support rails 25 and 26 appropriately for the number of conductors in the cable 49 to be connected and thus the number of contact elements 46 in the connector 42 or 43. The upper surfaces of the locator support rails 25 and 26 are provided with similar length scales 56 for positioning the connector locators 39 and 40 at the appropriate spacings for the cable harness to be constructed.

In use, connector locators such as connector locators 39 or 40, or both, are placed on and slid along the locator support rails 25 and 26 to position pairs of similar locators 39 or 40 in opposition at the desired spacings for the cable harness to be constructed. The locator support rails 25 and 26 are then pivoted forward and to the proper spacing for the cable and connectors to be utilized. Connector bodies 45 are positioned in the locators 39 and 40 and a flat cable is layed over the connector bodies 45 and the guide edges 51 of the locators 39 and 40 properly position the cable with respect to the connector bodies 45. The base plate 21 is then moved longitudinally to position the first of the connectors in the crimping position under the platen 12, a cover is positioned over the connector body 45 and cable 49 and the crimping press handle 11 is pivoted forward and downward to press the cover onto the body 45 and carry the conductors of the flat cable 49 into the contact elements 46 of the connector. The base plate 21 is then moved longitudinally successively to position the remainder of the connectors in the crimping position and the remaining covers are crimped onto the connector bodies to complete the harness. Because of the difference in height between the card edge connectors 42 and the socket connectors 43, the space between the bottom of the platen 12 and the base plate 21 in the fully crimped position of the press must be adjusted either by vertical adjustment of the platen position or by using platens of different heights.

I claim:

1. A cable harness assembly fixture comprising:

a crimping station defining a crimping position for applying a cable connector to a multi-conductor flat cable, an elongate base plate supported for movement with respect to said crimping station longitudinally of said base plate to position selected portions thereof in said crimping position, a pair of spaced, parallel, locator support rails supported on said base plate parallel to the longitudinal edges thereof, said support rails being movable transversely of said base plate to vary the spacing between them, means for retaining said locator support rails at selected spacings, a plurality of connector locators supported on each of said locator support rails, said connector locators being slidable along said rails, being securable to said support rails and being formed such that with said support rails set at a predetermined spacing two connector locators positioned in opposition, one on each of said support rails, will engage and position the body of a cable connector between them on said base plate, and means for aligning a multi-conductor flat cable with a cable connector body positioned between an opposed pair of said connector locators.

2. The cable harness assembly fixture of claim 1 wherein said locator support rails are supported for movement transversely of said base plate by a guide slot formed in said base plate adjacent each of the ends of each of said support rails, the guide slots for each support rail being parallel, and a guide follower depending from adjacent each end of each of said support rails to fit one in each of said guide slots.

3. The cable harness assembly fixture of claim 2 wherein said locator support rails are movable perpendicularly away from base plate and are resilienly biased toward said base plate and wherein said means for retaining said locator support rails at selected spacings comprises:

a series of similar apertures formed into the surface of said base plate, one series of apertures along a line parallel to each said guide slot, and a retention pin depending from adjacent each end of each of said support rails to fit one in each of said series of apertures.

4. The cable harness assembly fixture of claim 3 wherein the centerlines of said guide slots are at an acute angle to the longitudinal centerline of said base plate, the centerlines of the two slots at each end converging toward a point on the centerline of said base plate.

5. The cable harness assembly fixture of claim 1 wherein said means for aligning a multi-conductor flat cable comprises means on each said connector locator for guiding one edge of a multi-conductor flat cable to assure its proper location with respect to a connector body in said locator.

* * * * *